US005569054A

United States Patent [19]

Yagi et al.

[11] Patent Number: 5,569,054

[45] Date of Patent: Oct. 29, 1996

[54] ELECTRICAL CONNECTOR

[75] Inventors: Sakai Yagi; Tamio Watanabe, both of Shizuoka, Japan

[73] Assignee: Yazaki Corporation, Tokyo, Japan

[21] Appl. No.: 427,259

[22] Filed: Apr. 24, 1995

[30] Foreign Application Priority Data

Apr. 22, 1994 [JP] Japan ..... 6-84883

[51] Int. Cl.[6] ..... H01R 13/436

[52] U.S. Cl. ..... 439/752; 439/595

[58] Field of Search ..... 439/752, 595

[56] References Cited

U.S. PATENT DOCUMENTS

| | | | |
|---|---|---|---|
| 5,066,252 | 11/1991 | Kato et al. | 439/752 |
| 5,106,318 | 4/1992 | Endo et al. | 439/189 |
| 5,257,951 | 11/1993 | Maeda | 439/752 |
| 5,356,302 | 10/1994 | Inoue et al. | 439/595 |

FOREIGN PATENT DOCUMENTS

| | | | |
|---|---|---|---|
| 329276 | 2/1991 | Japan | H01R 13/42 |

*Primary Examiner*—Gary F. Paumen
*Assistant Examiner*—T. C. Patel
*Attorney, Agent, or Firm*—Sughrue, Mion, Zinn, Macpeak & Seas

[57] ABSTRACT

Terminals are inserted respectively into terminal receiving chambers in a housing, and then retaining pins of a second insertion retaining means are inserted respectively into retaining pin insertion holes in the housing, so that the terminals received and held in the housing are retained in a double retained manner. A slanting surface is formed on at least one of a distal end of each of the retaining pins and that outer surface of each of the terminals which can contact the retaining pin inserted into the retaining pin insertion hole 38, the slanting surface extending in a direction intersecting a direction of insertion of the retaining pin, and the slanting surface producing a force urging the associated terminals to move deeper in the corresponding terminal receiving chambers when the second insertion retaining means is attached to the housing.

3 Claims, 5 Drawing Sheets

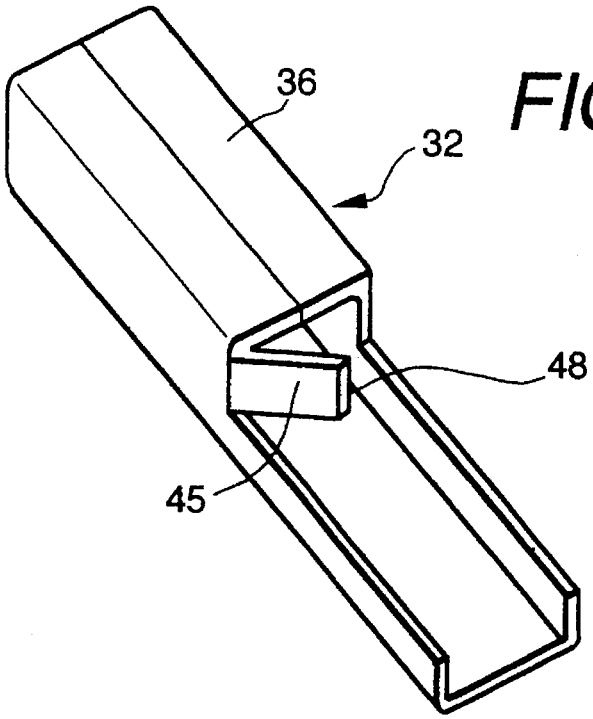
FIG. 6
FIG. 7
PRIOR ART
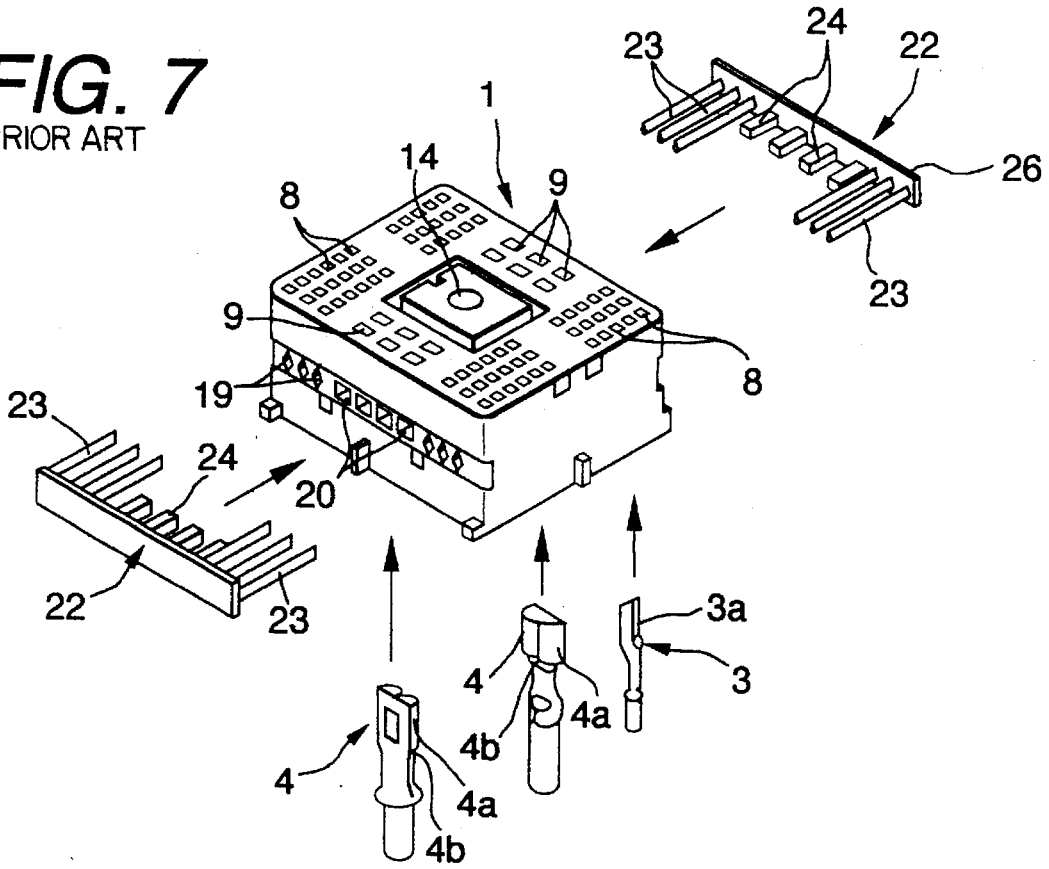

ELECTRICAL CONNECTOR

BACKGROUND OF THE INVENTION

1. Field of the Invention

This invention relates to a connector, and more particularly to a connector of the type in which each of the terminals, inserted respectively into corresponding terminal receiving chambers arranged in predetermined columns and rows in a connector housing, is retained in a double manner by a first retaining means, which is formed integrally with the connector housing, and projects into the associated terminal receiving chamber, and a second retaining means attached to the connector housing from an outer peripheral surface of the connector housing.

2. Related Art

A wire harness, heretofore used in electric circuits in an automobile, is connected at one end to various electric devices by male and female connectors fitted together. At such a portion as an instrument panel where many switches and instruments are provided in a concentrated manner, a large number of connectors are provided, and much time and labor are required for connecting these connectors, and besides a considerable space is occupied by the connectors. Under the circumstances, there has been used a connector of the complex type, and more specifically a plurality of connectors, receiving respective terminals of different sizes and shapes, have been combined together into a single connector by which a large number of electrical connections are made.

FIGS. 7 to 9 show such a conventional complex-type connector (see Japanese Patent Unexamined Publication No. 62-188186).

As shown in FIG. 7, this complex-type connector comprises a male connector housing 1 and a female connector housing (not shown) which are fitted together, thereby electrically connecting terminals, held in the male connecter housing, respectively to terminals held in the female connector housing.

The male connector housing 1 has terminal receiving chambers 8 and 9 arranged in predetermined columns and rows for respectively receiving two kinds of female terminals 3 and 4. Similarly, the female connector housing (not shown) has two kinds of terminal receiving chambers arranged in predetermined columns and rows for respectively receiving male terminals corresponding respectively to the female terminals 3 and 4 (That is, the male and female terminals are fitted together).

The number of terminals received and held by the male and female connector housings is large, and a considerable force is required for fitting the two connector housings together. Therefore, the fitting connection between the male and female connector housings is achieved by threading a tightening bolt (not shown) (which passes through a bolt mounting portion extending through a central portion of the female connector housing in the same direction as the direction of extension of the terminal receiving chambers) into an internally-threaded member (nut) 14 mounted at a central portion of the male connector housing 1.

The male and female connector housing have double-retaining mechanisms, respectively, and these double-retaining mechanisms are similar in construction to each other, and therefore the double-retaining mechanism of the male connector housing will be described below.

The female terminal 3 is smaller in width than the female terminal 4, and in the male connector housing 1, the narrower female terminals 3 are inserted respectively into three rows of terminal receiving chambers 8 counting from the right and left side edge of this connector housing, while the wider female terminals 4 are inserted respectively into three rows of terminal receiving chambers 9 provided at a central portion of this connector housing. The terminal receiving chambers 8 and 9 are so arranged that the terminals 3 and 4 received in these chambers are arranged or oriented differently from each other, for example, with base plate portions of the terminals 3 and 4 disposed perpendicularly to each other. As shown in FIG. 9, a first retaining means, such as a lance 16, 17, for engagement with an electrical contact portion 3*a*, 4*a* of the inserted female terminal 3, 4 to retain the terminal against withdrawal is formed within the terminal receiving chamber 8, 9.

Retaining pin insertion holes 19 and 20, each communicating the corresponding terminal receiving chambers in the same row with one another, are open to an outer peripheral surface of the male connector housing 1 in corresponding relation to the rows of terminal receiving chambers.

The retaining pin insertion holes 19 and 20 are used for attaching second insertion retaining means 22. As shown in FIG. 7, each of the second insertion retaining means 22 comprises a plurality of retaining pins 23 and 24 for insertion respectively into the associated retaining pin insertion holes 19 and 20 to retain the terminals 3 and 4 received respectively in the terminal receiving chambers 8 and 9, and a connecting portion 26 interconnecting proximal ends of these retaining pans 23 and 24 at intervals (pitch) corresponding to the intervals of the rows of retaining pin insertion holes 19 and 20 formed in the connector housing 1.

As shown in FIG. 9, the lance 16 engages a stamped hole in the base plate portion of the electrical contact portion 3*a* of the female terminal 3 to prevent withdrawal of the female terminal 3 received in the terminal receiving chamber 8. The retaining pin 23 of the second insertion retaining means 22 has a rhombic transverse cross-section, and a distal end of the retaining pin 23 engages a step portion at a rear end of the electrical contact portion 3*a*, received in the terminal receiving chamber 8, to retain the female terminal 3 already retained by the lance 16 to achieve the double retainment, thereby positively preventing withdrawal of the terminal 3.

The retaining pin 24 of the second insertion retaining means 22 has a rectangular transverse cross-section, and the adjacent retaining pins 24 hold a constricted neck portion 4*a* of the female terminal 4 to retain the same, thereby achieving the double retainment.

Namely, in the connector housing 1, the female terminals 3 and 4 are inserted into the respective terminal receiving chambers 8 and 9, and then the second insertion retaining means 22 are attached to the connector housing 1 respectively from the upper and lower sides of the outer peripheral surface thereof to retain the received female terminals 3 and 4 in a double manner, thereby preventing withdrawal of the female terminals 3 and 4 more positively.

As described above, the second insertion retaining means 22 for double retaining purposes are attached to the connector housing 1 after the female terminals 3 and 4 are inserted respectively into the terminal receiving chambers 8 and 9. At this time, if the female terminal 3, 4 fails to be completely inserted into a predetermined position where the female terminal is retained by the lance 16, 17, that is, the terminal 3 is in a half-inserted condition, the retaining pin 23, 24 of the subsequently-inserted second insertion retaining means 22 abuts at its distal end against the side of the half-inserted female terminal 3, 4. If the retaining pins 23 and 24 are inserted with a large force, there has been encountered a problem that the half-inserted female terminal 3, 4 or the retaining pin 23, 24 are so damaged that it is difficult to repair the damaged portion.

Furthermore, even if the operator detects the half-inserted condition of the female terminals 3, 4 through a sensation obtained when the retaining pins 23, 24 abuts against the half-inserted female terminal 3, 4, there is needed a cumbersome operation for correcting such a condition, in which the inserted retaining pins 23, 24 are withdrawn, and then are again brought into a completely-inserted condition after the female terminals are fully inserted. This results in a problem that the efficiency of the connector-assembling operation is lowered.

SUMMARY OF THE INVENTION

It is therefore an object of this invention to overcome the above problems, and more specifically to provide a connector in which even if any of terminals inserted into respective terminal receiving chambers in a connector housing is in a half-inserted condition, a subsequently-inserted retaining pin for double retaining purposes moves the half-inserted terminal deeper in the terminal receiving chamber to bring the same into a proper inserted condition, thereby positively achieving the proper double-retained condition, and damage to the terminal and the retaining pin which would be caused by impingement of the retaining pin on the half-inserted terminal is prevented, and a cumbersome operation for correcting the half-inserted condition is not needed, and the efficiency of the assembling operation is excellent.

The above object has been achieved by a connector comprising a connector housing having a plurality of terminal receiving chambers arranged in predetermined rows, and first retaining means for respectively retaining terminals inserted respectively in the terminal receiving chambers; and second insertion retaining means attached to the connector housing from the outside of the connector housing for retaining the terminals, wherein retaining pin insertion holes, each communicating the terminal receiving chambers in the same row with one another, are open to an outer peripheral surface of the connector housing in corresponding relation to the rows of terminal receiving chambers, and the second insertion retaining means comprises a plurality of retaining pins for insertion respectively into the retaining pin insertion holes to retain the terminals received respectively in the terminal receiving chambers, and a connecting portion interconnecting proximal ends of the retaining pins at an interval corresponding to an interval of the retaining pin insertion holes in the connector housing, wherein a slanting surface is formed on at least one of a distal end of each of the retaining pins and the outer surface of each of the terminals which can contact the retaining pin inserted into the retaining pin insertion hole, the slanting surface extending in a direction intersecting a direction of insertion of the retaining pin, and the slanting surface producing a force urging the associated terminals to move deeper in the corresponding terminal receiving chambers when the second insertion retaining means is attached to the connector housing.

In the above connector, the slanting surface is formed on each of the terminals for producing the force urging the terminal to move deeper in the corresponding terminal receiving chamber when the second insertion retaining means is attached, and the slanting surface is defined by a projected plate portion which is part of a sheet material constituting the terminal, and is projected obliquely in a cantilever manner. With this construction, the above object can be achieved.

In the above construction of the present invention, the terminals are inserted respectively into the terminal receiving chambers in the connector housing, and are retained respectively by the first retaining means provided respectively in the terminal receiving chambers. Then, the second insertion retaining means is attached to the connector housing from the outer peripheral surface thereof, thereby achieving the double retaining of the terminals received in the respective terminal receiving chambers. If any of the terminals, inserted respectively in the terminal receiving chambers in the connector housing, fails to be completely inserted into a predetermined position, that is, if any terminal is in a half-inserted condition, a pressing operation is effected by the slanting surface or surfaces, formed on one or both of the terminal and the retaining pin, when the retaining pin of the second insertion retaining means is inserted into the retaining pin insertion hole in the connector housing, so that the pressing of the slanting surface moves the half-inserted terminal deeper in the terminal receiving chamber to bring the same into a completely-insertion condition, thereby achieving the proper double retaining condition.

Therefore, damage to the terminal and the retaining pin which would otherwise be caused by impingement of the retaining pin on the half-inserted terminal is prevented, and also a cumbersome operation for correcting the half-inserted condition is not needed, and an improved efficiency of the assembling operation can be achieved.

In the case where the slanting surface, formed on the terminal for producing a force urging the terminal deeper in the terminal receiving chamber when the second insertion retaining means is attached, is defined by the projected plate portion which is part of the metal sheet constituting the end portion of the terminal, and projects in a cantilever manner from this end portion of the terminal, so that the resiliency of the projected plate portion can urge the terminal in its inserting direction, an undue force will not be applied when the terminal and the retaining pin are engaged with each other through the slanting surface. And besides due to the resilient force of the slanting surface, the effect of moving the terminal deeper in the terminal receiving chamber can be maintained satisfactorily, anti damage due to the impingement of the retaining pin on the terminal can be prevented positively.

Furthermore, the cantilever projected plate portion providing the slanting surface can be easily formed integrally with the terminal when the terminal of a predetermined configuration is formed by blanking from a metal sheet and bending. This is advantageous in that the processing cost is kept low.

BRIEF DESCRIPTION OF THE DRAWINGS

FIG. 2 is a view as seen in a direction of arrow A of

FIG. 6 is a perspective view of a connector terminal of the invention having a modified slanting surface;

FIG. 7 is a perspective view showing the construction of a prior art connector;

DETAILED DESCRIPTION OF THE PREFERRED EMBODIMENTS

Figure 1:
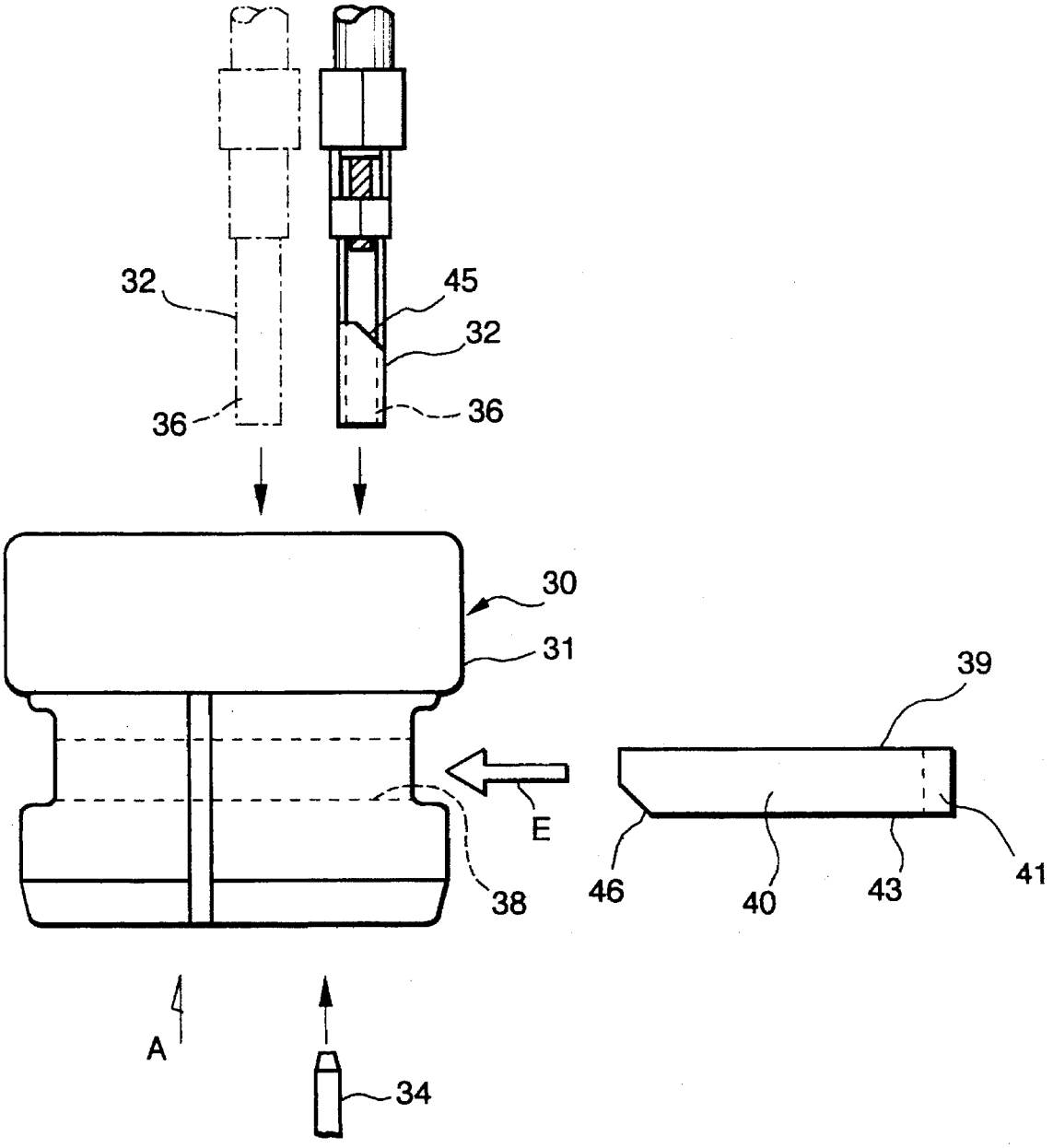
FIG. 1 is a plan view showing the construction of a preferred embodiment of the present invention.

FIGS. 1 to 4 shows one preferred embodiment of a connector of the present invention. In the connector 30 of this embodiment, a male connector housing 31 and a female connector housing (not shown) are fitted together, so that terminals received in the male connector housing are electrically connected respectively to terminals received in the female terminal. The male connector housing 31 has terminal receiving chambers 33 arranged in 2 (upper and lower) rows and 7 columns for receiving the female terminals 32, respectively. Similarly, the female connector housing (not shown) has terminal receiving chambers arranged in 2 (upper and lower) rows and 7 columns for respectively receiving the male terminals 34 corresponding respectively to the female terminals 32.

The male and female connector housings have double-retaining mechanisms, respectively, and these double-retaining mechanisms are similar in construction to each other, and therefore the double-retaining mechanism of the male connector housing will be described below.

Figure 2:
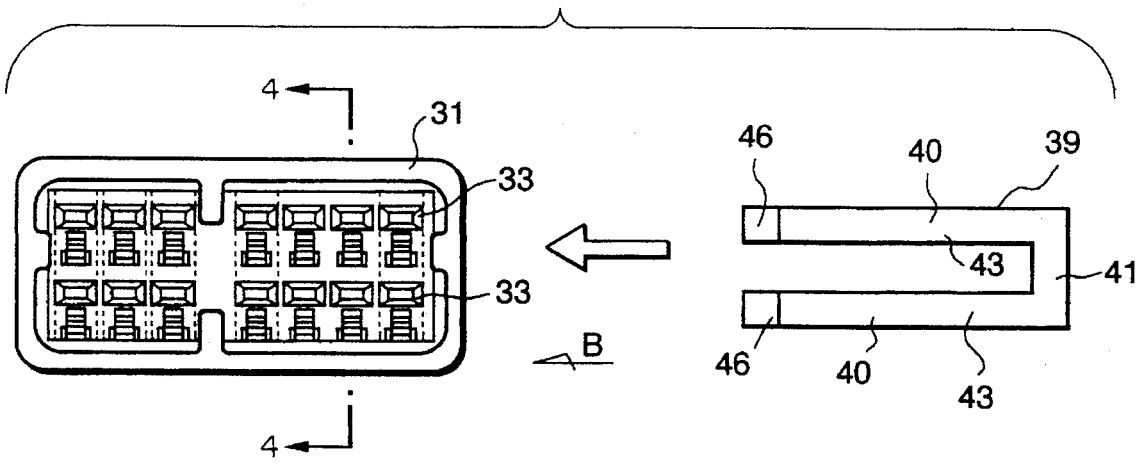
Figure 4:
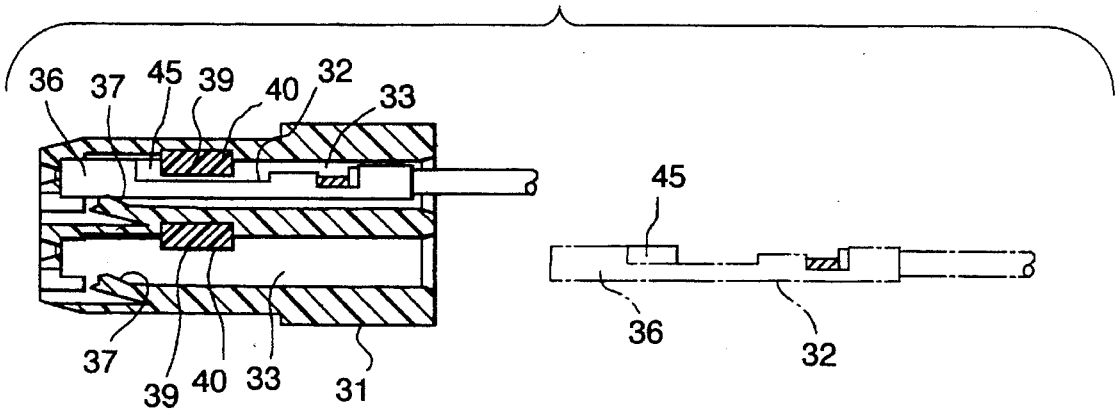
FIG. 4 is a cross-sectional view taken along the line 4—4 of FIG. 2.

As described above, the male connector housing 31 has the terminal receiving chambers 33 arranged in 2 (upper and lower) rows and 7 columns as shown in FIG. 2. As shown in FIG. 4, a lance 37, serving as a first retaining means for engagement with an electrical contact portion 36 of the inserted female terminal 32 to prevent withdrawal of the terminal, is formed within each of the terminal receiving chambers 33.

Figure 3:
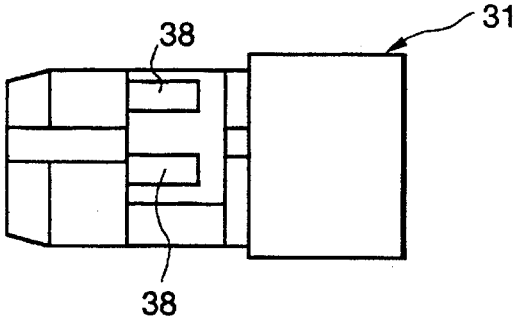
FIG. 3 is a view as seen in a direction of arrow B of FIG. 2.

As shown in FIG. 3, retaining pin insertion holes 38, each communicating with the plurality of (seven) corresponding terminal receiving chambers 33 in the same row, are open to an outer peripheral surface of the male connector housing 31 in corresponding relation to the rows of terminal receiving chambers 33.

These retaining pin insertion holes 38 are used for attaching a second insertion retaining means 39. As shown in FIGS. 1 and 2, the second insertion retaining means 39 comprises a pair of upper and lower retaining pins 40 for insertion respectively into the retaining pin insertion holes 38 to retain the female terminals 32 received respectively in the terminal receiving chambers 33, and a connecting portion 41 interconnecting proximal ends of these retaining pins 40 at an interval (pitch) corresponding to the interval of the retaining pin insertion holes 38 formed in the connector housing 1.

As shown in FIG. 4, the lance 37 engages a stamped hole in a base plate portion of the electrical contact portion 36 of the female terminal 32 to prevent withdrawal of the female terminal 32 inserted in the terminal receiving chamber 33. The retaining pin 40 of the second insertion retaining means 39 is a tongue-like bar of a rectangular transverse cross-section. A side surface 43 of the retaining pin 40 engages a step portion at a rear end of the electrical contact portion 36 received in the terminal receiving chamber 33, thereby retaining the female terminal 3 already retained by the lance 37, thus achieving the double retaining to positively prevent withdrawal of the female terminal 3.

Namely, in the connector housing 31, the second insertion retaining means 39 is attached to the connector housing 31 after the female terminals 32 are inserted respectively into the terminal receiving chambers 33, thereby achieving the double retaining of the received female terminals 32 to prevent withdrawal of the female terminals 32 more positively.

In this embodiment, a slanting surface 45 is formed on that outer surface of a side portion of each terminal 32 which can contact the retaining pin 40 inserted into the retaining pin insertion hole 38, and a slanting surface 46 is formed on the distal end of each retaining pin 40, the two slanting surfaces 45 and 46 extending in directions intersecting the direction (indicated by arrow E) of insertion of the retaining pin 40. When the second insertion retaining means 39 is attached to the connector housing, the slanting surface 46 is abutted against the slanting surface 45 to produce a force urging the terminal 32 deeper into the terminal receiving chamber 33.

The angle of inclination of the slanting surfaces 45 and 46 is suitably determined in view of the magnitude of an insertion force required for completely inserting the female terminal 32 into a predetermined position (where the female terminal 32 is retained by the lance 37) in the terminal receiving chamber 33.

Figure 5A:
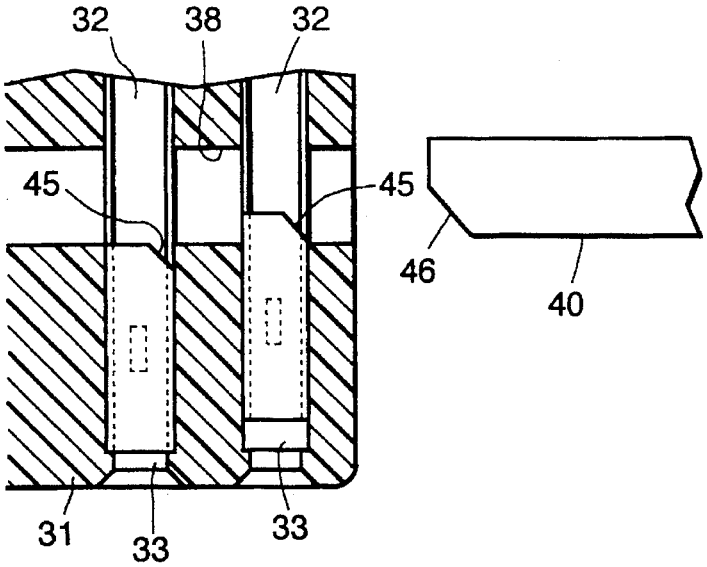
FIGS. 5A–5C are views explanatory of the operation of the above embodiment of the invention.
Figure 5B:
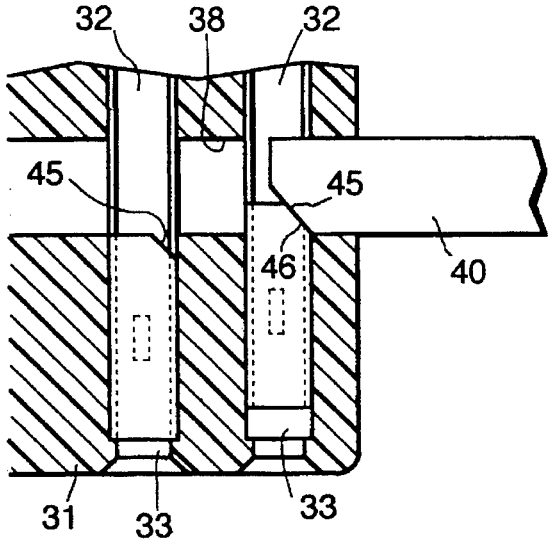
Figure 5C:
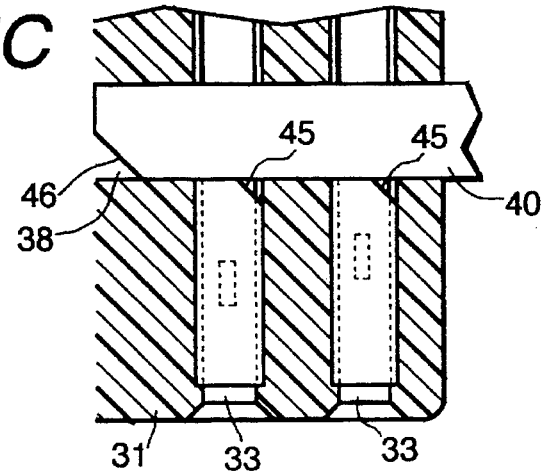
Figure 8:
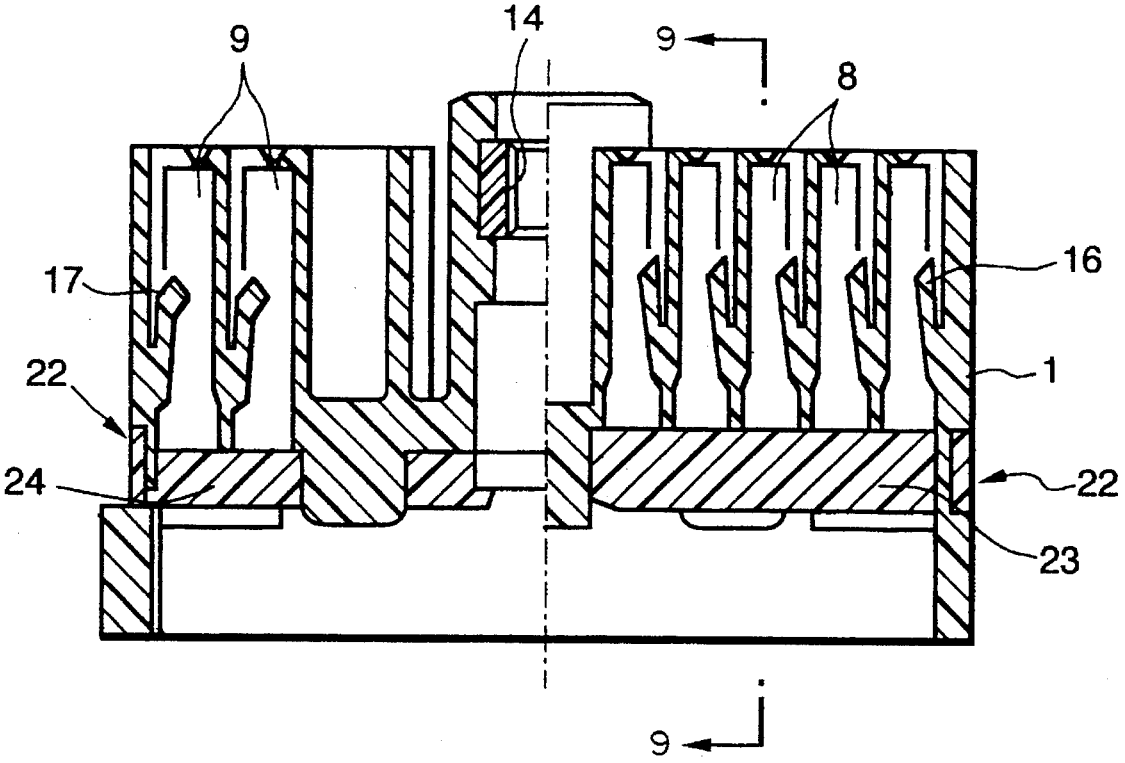
FIG. 8 PRIOR ART
FIG. 8 is a view explanatory of a retained condition achieved by a second insertion retaining means of the prior art connector of FIG. 7.
Figure 9:
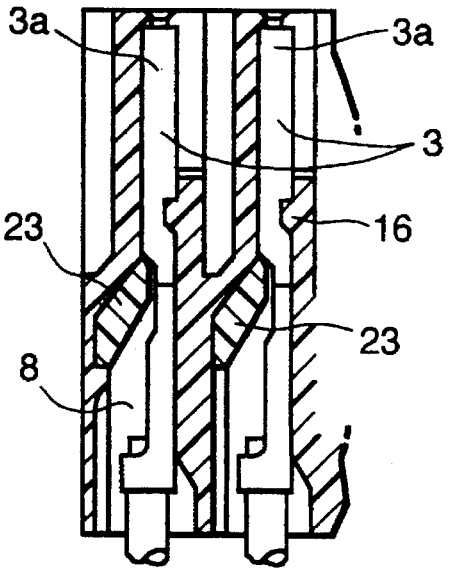
FIG. 9 PRIOR ART
FIG. 9 is a cross-sectional view taken along the line 9—9 of FIG. 8.

In the connector 30 of this embodiment, the terminals 32 are inserted respectively into the terminal receiving chambers 33 in the connector housing 31, and are retained respectively by the lances 37 provided respectively in the terminal receiving chambers 33, and then the second insertion retaining means 39 is attached to the connector housing 1 from the outer side surface thereof, thereby achieving the double retaining of the terminals 32 received and held in the respective terminal receiving chambers 33. At this time, if any of the female terminals 32 fails to be completely inserted into the predetermined position, that is, the terminal 32 (the right terminal in FIG. 5A) is in a half-inserted condition, the slanting surface 46 formed on the retaining pin 40 is pressed against the slanting surface 45, formed on the half-inserted terminal 32, as shown in FIG. 5B when the retaining pin 40 of the second insertion retaining means 39 is inserted into the retaining pin insertion hole 38 in the connector housing 31, and as a result of the pressing of the slanting surface 46 against the slanting surface 45, the half-inserted terminal 32 is moved deeper (downward in the drawings) in the terminal receiving chamber 33, so that the terminal 32 is brought into the proper inserted condition, thus positively achieving the proper double-retained condition, as shown in FIG. 5C.

With this construction, damage to the terminal 32 and the retaining pin 40, which would otherwise be caused upon impingement of the retaining pin 40 on the half-inserted terminal 32, can be prevented, and also a cumbersome operation to correct the half-inserted condition is not needed, and an improved efficiency of the assembling operation can be achieved.

The female terminal 32 is formed into the predetermined configuration usually by blanking from a metal sheet and bending, and in this case, the slanting surface 45 formed on the female terminal 32 can be defined by a projected plate portion 48 which is part of the metal sheet constituting the end portion of the female terminal 32, and projects in a cantilever manner from this end portion of the female terminal 32, so that the resiliency of the projected plate portion 48 can urge the terminal 32 in its inserting direction.

In such a construction, an undue force is not applied when the retaining pin 40 engages the terminal 32 through the slanting surfaces 45 and 46, and due to the resilient force of the slanting surface 45, the effect of moving the terminal 32 deeper in the terminal receiving chamber 33 can be maintained satisfactorily, and damage due to the impingement of the retaining pin 40 on the terminal 32 can be prevented positively.

Furthermore, the cantilever projected plate portion 48 providing the slanting surface 45 can be easily formed integrally with the female terminal 32 when the female terminal 32 of the predetermined configuration is formed by blanking from a metal sheet and bending. This is advantageous in that the processing cost is kept low.

In the above embodiment, although the terminal receiving chambers 33 in the connector housings are arranged in the two (upper and lower) rows, the arrangement of the terminal receiving chambers 33 is not limited to that described in the above embodiment, and the arrangement of the retaining pins 40 of the second insertion retaining means 39, as well as the arrangement of the retaining insertion holes 38, can be suitably changed in accordance with the arrangement of the terminal receiving chambers 33 in the connector housing 31.

In the above embodiment, although the slanting surfaces 45 and 46 are formed respectively on the terminal 32 and the retaining pin 40 for moving the terminal 32 deeper in the terminal receiving chamber 33, such a slanting surface may be formed on one of the terminal 32 and the retaining pin of the second insertion retaining means 39.

In the above construction of the present invention, the terminals are inserted respectively into the terminal receiving chambers in the connector housing, and are retained respectively by the first retaining means provided respectively in the terminal receiving chambers. Then, the second insertion retaining means is attached to the connector housing from the outer peripheral surface thereof, thereby achieving the double retaining of the terminals received in the respective terminal receiving chambers. If any of the terminals, inserted respectively in the terminal receiving chambers in the connector housing, fails to be completely inserted into a predetermined position, that is, any terminal is in a half-inserted condition, a pressing operation is effected by the slanting surface or surfaces, formed on one or both of the terminal and retaining pin, when the retaining pin of the second insertion retaining means is inserted into the retaining pin insertion hole in the connector housing, so that the pressing of the slanting surface moves the half-inserted terminal deeper in the terminal receiving chamber to bring the same into a completely-insertion condition, thereby achieving the proper double retaining condition.

Therefore, damage to the terminal and the retaining pin which would otherwise be caused by impingement of the retaining pin on the half-inserted terminal is prevented, and also a cumbersome operation for correcting the half-inserted condition is not needed, and an improved efficiency of the assembling operation can be achieved.

In the case where the slanting surface, formed on the terminal for producing a force urging the terminal deeper in the terminal receiving chamber when the second insertion retaining means is attached, is defined by the projected plate portion which is part of the metal sheet constituting the end portion of the terminal, and projects in a cantilever manner from this end portion of the terminal, so that the resiliency of the projected plate portion can urge the terminal in its inserting direction, an undue force will not be applied when the terminal and the retaining pin are engaged with each other through the slanting surface. And besides thanks to the resilient force of the slanting surface, the effect of moving the terminal deeper in the terminal receiving chamber can be maintained satisfactorily, and damage due to the impingement of the retaining pin on the terminal can be prevented positively.

Furthermore, the cantilever projected plate portion providing the slanting surface can be easily formed integrally with the terminal when the terminal of a predetermined configuration is formed by blanking from a metal sheet and bending. This is advantageous in that the processing cost is kept low.

What is claimed is:

1. A connector comprising:

a connector housing having a plurality of terminal receiving chambers arranged in predetermined rows, said connector housing having first retaining means for respectively retaining terminals inserted respectively in said terminal receiving chambers;

retaining pin insertion holes, each communicating with said terminal receiving chambers in the same row with one another, being open to an outer peripheral surface of said connector housing in corresponding relation to the rows of terminal receiving chambers;

second insertion retaining means, attached to said connector housing from the outside of said connector housing, for retaining said terminals, said second insertion retaining means including:

a plurality of retaining pins for inserting respectively into said retaining pin insertion holes to retain said terminals received respectively in said terminal receiving chambers;

a connecting portion interconnecting proximal ends of said retaining pins at an interval corresponding to an interval of said retaining pin insertion holes in said connector housing; and a slanting surface formed on a distal end of each of said retaining pins, said slanting surface extending in a direction intersecting a direction of insertion of said retaining pin, and said slanting surface producing a force urging the associated terminals to move deeper in the corresponding terminal receiving chambers when said second insertion retaining means is attached to said connector housing.

2. A connector according to claim 1, wherein each of said terminals has a slanting surface formed on an outer surface of a side portion of each of said terminals for abutting one of said slanting surfaces of a corresponding one of said retaining pins.

3. A connector according to claim 2, wherein said slanting surface of each of said terminals is defined by a projected plate portion which is part of a sheet material forming each of said terminals, and is projected obliquely in a cantilever manner.

* * * * *